US007648429B2

(12) United States Patent
Nagasawa

(10) Patent No.: US 7,648,429 B2
(45) Date of Patent: Jan. 19, 2010

(54) GOLF BALL

(75) Inventor: Hiroyuki Nagasawa, Saitama-ken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/039,513

(22) Filed: Feb. 28, 2008

(65) Prior Publication Data

US 2008/0146382 A1 Jun. 19, 2008

Related U.S. Application Data

(62) Division of application No. 11/280,181, filed on Nov. 17, 2005, now Pat. No. 7,367,902.

(51) Int. Cl.
*A63B 37/06* (2006.01)

(52) U.S. Cl. ..... 473/378

(58) Field of Classification Search ..... 473/378
See application file for complete search history.

(56) References Cited

U.S. PATENT DOCUMENTS

| | | | | |
|---|---|---|---|---|
| 4,848,770 | A * | 7/1989 | Shama | 473/373 |
| 6,569,919 | B1 | 5/2003 | Noguchi et al. | |
| 2004/0266553 | A1 | 12/2004 | Park et al. | |
| 2004/0266554 | A1 | 12/2004 | Park et al. | |
| 2006/0041047 | A1 * | 2/2006 | Ramsey | 524/430 |

FOREIGN PATENT DOCUMENTS

| | | | |
|---|---|---|---|
| JP | 3363818 | B2 | 10/2002 |

* cited by examiner

*Primary Examiner*—Raeann Trimiew
(74) *Attorney, Agent, or Firm*—Sughrue Mion, PLLC

(57) ABSTRACT

In a golf ball composed of a core, a cover of at least one layer that encloses the core, and a plurality of dimples on an outermost layer of the cover, at least one constituent element contains from 0.5 to 30 parts by weight of one or more rare-earth oxide composed of a single rare-earth element, or a rare-earth mixed oxide composed of a plurality of rare-earth elements mixed in a desired ratio, per 100 parts by weight of a base material. Unlike ordinary golf balls, the golf ball of the invention has a visibility which differs under display or indoor light as opposed to outdoors, and is also very fashionable.

2 Claims, No Drawings

GOLF BALL

This is a divisional of application Ser. No. 11/280,181 filed Nov. 17, 2005, now U.S. Pat. No. 7,367,902. The entire disclosures of the prior application, application Ser. No. 11/280,181, is hereby incorporated by reference.

BACKGROUND OF THE INVENTION

The present invention relates to a golf ball which uses an inorganic pigment having photochromism. More particularly, the invention relates to a golf ball which exhibits a reversible change in color between exposure to a light source having a spectral distribution with a peak at the same wavelength as the absorption peak of the inorganic pigment in the visible light spectrum and exposure to another light source, and thus has excellent visibility and fashionability.

Up until now, golf balls have been predominantly white in color. Recently, however, as the range of individuals playing golf has grown, highly fashionable golf balls targeted at beginners or women are being created.

For example, published U.S. Patent Application No. 2004/0266553 discloses a golf ball which exhibits a color change under ultraviolet irradiation. However, because the pigment used in this golf ball is an organic compound, there are problems with the reversibility and life of the color change.

Published U.S. Patent Application No. 2004/0266554 uses a photoluminescent pigment, but the cost rises on account of encapsulation. Moreover, the pigment is a phosphorescent pigment, and so the speed of the color change response to visible light irradiation is slow. Also, the influence of temperature on the brightness of luminescence and the color in the luminous time period cannot be disregarded.

In addition, JP No. 3363818 discloses art relating to a reversibly color changeable composition. However, no specific means is described for conferring fashionability while maintaining properties such as flight characteristics, feel on impact and durability when this art is applied to golf balls.

SUMMARY OF THE INVENTION

It is thus an object of the invention to provide a golf ball which exhibits a reversible change in color between exposure to a source of visible light having a spectral distribution with a peak at a specific wave length and exposure to another light source, which differs from ordinary golf balls by having a different visibility under display or indoor light as opposed to outdoors, and which is also highly fashionable.

As a result of extensive investigations, we have discovered that, in a golf ball which is composed of a core, a cover of at least one layer that encloses the core, and a plurality of dimples on an outermost layer of the cover, by containing in at least one constituent element thereof from 0.5 to 30 parts by weight of one or more rare-earth oxide composed of a single rare-earth element, or a rare-earth mixed oxide composed of a plurality of rare-earth elements mixed in a desired ratio, per 100 parts by weight of a base material, the golf ball has a different visibility under display or indoor light as opposed to outdoors, is highly fashionable, and incurs no loss in flight characteristics.

In other words, after extensive investigations on ways of addressing the need for golf balls which exhibit a wide variety of colors and also are highly stylish in a way that appeals to the tastes of a broad range of golfers, including beginners and women golfers, we have found that these desires can be met by using a specialty pigment which changes color under a three-wavelength fluorescent lamp; that is, by using an inorganic ultrafine particulate pigment which exhibits a change in color between exposure to sunlight and exposure to a three-wavelength fluorescent lamp and including a suitable amount of the pigment in a constituent element of the golf ball.

The significance of using here a specialty pigment (e.g., holmium oxide) which changes color under a three-wavelength fluorescent light is described below.

The mechanism by which color rendering properties arise is based on the wavelength properties of each light source and on the reflectance properties of the holmium oxide. Sunlight and ordinary electric lamps emit light over a continuous wavelength range, whereas a three-wavelength fluorescent lamp strongly emits light only at certain wavelengths and has in particular a green emission peak at 540 nm. Holmium oxide has a reflectance with a large absorption peak at 540 nm. Hence, the green color of a three-wavelength fluorescent light is absorbed, so that holmium oxide, which appears yellow in sunlight, becomes reddish and appears to change to a pink color.

Accordingly, the invention provides the following golf balls.

[1] A golf ball composed of a core, a cover of at least one layer that encloses the core, and a plurality of dimples on an outermost layer of the cover, the ball being characterized by containing in at least one constituent element thereof from 0.5 to 30 parts by weight of one or more rare-earth oxide composed of a single rare-earth element, or a rare-earth mixed oxide composed of a plurality of rare-earth elements mixed in a desired ratio, per 100 parts by weight of a base resin.

[2] The golf ball of [1], wherein the rare-earth oxide or rare-earth mixed oxide has an average particle size of 10 to 100 nm.

[3] The golf ball of [1], wherein the rare-earth oxide or rare-earth mixed oxide is included within an outermost cover layer made of a thermoplastic or thermoset resin.

[4] The golf ball of [3], wherein the thermoplastic resin has a melt flow index of at least 0.5 g/10 min, a Shore D hardness of at least 40, and a rebound resilience according to JIS-K 7311 of at least 30%.

[5] The golf ball of [3], wherein the thermoplastic resin is an ionomer or a thermoplastic polyurethane.

[6] The golf ball of [3], wherein the thermoset resin is a thermoset polyurethane resin or a thermoset polyurea resin and has a Shore D hardness of at least 40 and a rebound resilience according to JIS-K 7311 of at least 30%.

[7] The golf ball of [1] which exhibits a change in color between exposure to a light source having a spectral distribution with a peak at substantially the same wavelength as at least one absorption peak of the rare-earth oxide or rare-earth mixed oxide in the visible light spectrum, and exposure to another light source.

[8] The golf ball of [1], wherein the rare-earth oxide or rare-earth mixed oxide is included in a coating.

[9] The golf ball of [1] which has a constituent element made of a material prepared by compounding the rare-earth oxide or rare-earth mixed oxide in a transparent or semi-transparent resin base, and which also has another, adjoining, constituent element that includes a colorant.

[10] A golf ball composed of a ball surface on which markings which may include lettering or a graphic image are printed with ink, wherein the marking ink includes from 1 to 50 parts by weight of one or more rare-earth oxide composed of a single rare-earth element, or a rare-earth mixed oxide composed of a plurality of rare-earth elements mixed in a desired ratio, per 100 parts by weight of an ink base.

[11] A one-piece golf ball composed of a rare-earth oxide or a rare-earth mixed oxide compounded in a core-forming rubber composition or in a coat-forming coating material.

DETAILED DESCRIPTION OF THE INVENTION

The invention is described more fully below. The golf ball according to one aspect of the invention is a multi-piece golf ball having a construction of two or more layers composed of a solid core enclosed by a cover of at least one layer.

The solid core can be formed using a known rubber composition. The base rubber is exemplified by polybutadiene. Specifically, it is recommended that the base rubber be composed primarily of cis-1,4-polybutadiene having a cis structure content of at least 40%. The base rubber may also contain, together with the foregoing polybutadiene, other types of rubber, such as natural rubber, polyisoprene rubber or styrene-butadiene rubber.

The metal salt (e.g., zinc salt, magnesium salt, calcium salt) of an unsaturated fatty acid (e.g., methacrylic acid, acrylic acid), or an ester compound such as trimethylolpropane trimethacrylate, may be compounded in the rubber composition as a co-crosslinking agent. For a high resilience, the use of zinc acrylate is especially preferred. Such co-crosslinking agents can be included in an amount of generally at least 10 parts by weight, and preferably at least 15 parts by weight, but not more than 50 parts by weight, and preferably not more than 40 parts by weight, per 100 parts by weight of the base rubber.

An organic peroxide can be included in the rubber composition. Illustrative examples include 1,1-bis(t-butylperoxy-3,3,5-trimethylcyclohexane), dicumyl peroxide, di(t-butylperoxy)-meta-diisopropylbenzene and 2,5-dimethyl-2,5-di-t-butylperoxyhexane. Examples of commercially available products include Percumil D (produced by NOF Corporation) and Trigonox 29-40 (Kayaku Akzo KK). The amount of organic peroxide included per 100 parts by weight of the base resin is generally at least 0.1 part by weight, and preferably at least 0.5 part by weight, but not more than 5 parts by weight, and preferably not more than 2 parts by weight.

If necessary, the above composition may include also various types of additives. Examples of such additives include sulfur, antioxidant, zinc oxide, barium sulfate, the zinc salt of pentachlorothiophenol and zinc stearate. No particular limitation is imposed on the amounts in which these additives are compounded.

The core has a diameter of preferably at least 32.0 mm, and more preferably at least 33.0 mm, but preferably not more than 40.5 mm, and more preferably not more than 39.5 mm.

The solid core has a deflection hardness (amount of deflection (deformation) when subjected to a load of 1275 N (130 kgf) from an initial load of 98 N (10 kgf)) of 2.5 to 5.0 mm, preferably 3.0 to 4.5 mm, and more preferably 3.5 to 4.0 mm. If the deflection hardness is too low, the golf ball may have a hard feel when hit with a driver and a poor scuff resistance. On the other hand, if the deflection hardness is too high, the ball may have too soft a feel when hit with a driver and a considerably shorter distance of travel.

The solid core can be produced by a known method. To obtain a solid core from the core-forming rubber composition, preferred use can be made of a process in which the composition is masticated using an ordinary mixing apparatus (e.g., a Banbury mixer, kneader or roll mill), and the resulting compound is compression molded in a core mold.

Next, in the practice of the invention, the solid core is encased within a cover of one or more layers. The base material of the cover is preferably a thermoplastic resin or a thermoplastic elastomer. Exemplary thermoplastic resins include ionomer resins. Commercial ionomer resins that may be used include Himilan (produced by DuPont-Mitsui Polychemicals Co., Ltd.) Surlyn (E.I. du Pont de Nemours and Co.) and Iotek (Exxon-Mobil Chemical). Exemplary thermoplastic elastomers include polyester, polyamide, polyurethane, olefin and styrene elastomers. Commercial thermoplastic elastomers that may be used include Hytrel (DuPont-Toray Co., Ltd.), Perprene (Toyobo Co., Ltd.), Pebax (Toray Industries, Inc.), Pandex (Dainippon Ink & Chemicals, Inc.), Santoprene (Monsanto Chemical Co.), Tuftec (Asahi Kasei Kogyo Co., Ltd.) and Dynaron (JSR Corporation). It is preferable for the thermoplastic resin or thermoplastic elastomer to be an ionomer resin or a thermoplastic polyurethane elastomer.

If a thermoplastic resin is used as the base material of the cover, it is preferable for the thermoplastic resin to have a melt flow index of at least 0.5 g/10 min, a Shore D hardness of at least 40, and a rebound resilience according to JIS-K 7311 of at least 30%.

If a thermoset resin is used as the base material of the cover, it is preferable for the thermoset resin to be a thermoset polyurethane resin or a thermoset polyurea resin. In such a case, it is preferable for the resin material to have a Shore D hardness of at least 40 and a rebound resilience according to JIS-K 7311 of at least 30%.

It is preferable to use as the cover material a transparent or semi-transparent resin. To impart color variation to the ball, the transparent or semi-transparent resin may be colored by adding various types of pigments. For example, luster pigments such as pearlescent pigments can be used. Also, insofar as the objects of the invention are attainable, a suitable amount of inorganic fillers such as titanium oxide may be included. Specifically, from 0.01 to 2 parts by weight of an inorganic filler may be included per 100 parts by weight of the base resin.

In the present invention, the ball contains in at least one constituent element thereof one or more rare-earth oxide composed of a single rare-earth element or a rare-earth mixed oxide composed of a plurality of rare-earth elements mixed in a desired ratio. "Constituent element" refers herein to, for example, the core, cover (e.g., inside cover, outside cover), an applied coat or markings on the golf ball.

Illustrative examples of the rare-earth oxide composed of a single rare-earth element include holmium oxide, praseodymium oxide, neodymium oxide, erbium oxide, lanthanum oxide and cerium oxide. The use of holmium oxide is preferred.

The content of the rare-earth oxide or rare-earth mixed oxide per 100 parts by weight of the base resin is preferably from 0.5 to 30 parts by weight, more preferably from 0.7 to 20 parts by weight, and most preferably from 0.8 to 10 parts by weight. If too little is added, sufficient is color rendering properties may not be achieved. On the other hand, the addition of too much will provide excellent color rendering properties, but may compromise the performance required of the golf ball, such as rebound and durability.

The rare-earth oxide or rare-earth mixed oxide has an average particle size of preferably 10 to 100 nm, and more preferably 15 to 60 nm. If the particle size is too small, workability during resin mixing may worsen due to undesirable effects such as agglomeration. On the other hand, if the particle size is too large, for reasons having to do with the specific surface area, a larger amount must be compounded to achieve the desired properties than when the particle size is small.

It is recommended that the cover has a Shore D hardness of at least 40, and preferably at least 43, but not more than 62, and preferably not more than 60. If the cover is too hard, the ball is less likely to take on an appropriate spin rate on approach shots, which may compromise the controllability. On the other hand, if the Shore D hardness is too low, the ball may have a poor rebound, lowering the distance of travel.

It is desirable for the cover to be formed to a thickness per layer of at least 0.5 mm, and preferably at least 0.8 mm, but not more than 3.0 mm, and preferably not more than 2.2 mm. A golf ball having a cover that is too thin may fail to achieve a sufficient spin performance and may have a poor durability to cracking with repeated impact.

The cover of the inventive golf ball may be composed of two or more layers. The cover layer (abbreviated below as "inner cover layer") which adjoins the outermost layer of the cover in such a case is described.

The base material of the inner cover layer is a thermoplastic resin. Suitable use may be made here of any of the thermoplastic resins mentioned above in connection with the above-described outermost layer of the cover.

It is recommended that the inner cover layer has a Shore D hardness of at least 45, and preferably at least 48, but not more than 55, and preferably not more than 53. If the inner cover layer has a Shore D hardness that is too small, the ball may have a poor rebound, shortening the distance of travel. On the other hand, if the Shore D hardness is too large, the ball may have a poor feel on impact and an inferior scuff resistance.

It is desirable for the inner cover layer to be formed so as to have a thickness of at least 0.8 mm, and preferably at least 1.2 mm, but not more than 2.2 mm, and preferably not more than 1.8 mm. If the cover is too thin, the ball may have a poor durability to cracking with repeated impact. On the other hand, if the cover is too thick, the ball rebound of the ball may decrease, shortening the distance of travel.

In the invention, to impart even greater color variation and also enable highly fashionable golf balls to be provided, it is desirable to use as the outermost cover layer material a composition prepared by compounding the is above-described rare-earth oxide or rare-earth mixed oxide in a transparent or semi-transparent base resin, and to add various types of colorants to the base resin of the adjoining inner cover layer.

Various known materials can be used as such colorants. For example, blue pigments that may be used include Prussian blue, phthalocyanine blue and cobalt blue. Yellow pigments that may be used include chrome yellow, zinc yellow, cadmium yellow, yellow iron oxide and nickel titanium yellow.

Various additives, such as UV absorbers, antioxidants, metal soaps, pigments other than the above, and inorganic fillers, may be added in appropriate amounts to the base resin or resins of the cover.

A known process such as injection molding or compression molding may be employed to obtain golf balls composed of a solid core encased within the above-described cover. For example, when injection molding is carried out, production may involve setting a prefabricated solid core within the mold and injecting the cover material into the mold by a conventional method.

The golf ball of the invention has a cover of at least one layer. In addition to the above-described outermost cover layer and inner cover layer, the golf ball may also have one or more intermediate layer between the solid core and the inner cover layer. The base resin described above in connection with the inner cover layer may be suitably used as the base resin in the intermediate layer.

In the golf ball of the invention that is formed as described above, it is recommended that the ball itself has a deflection hardness, measured as the amount of defection (or deformation) when subjected to a load of 1275 N (130 kgf) from an initial load of 98 N (10 kgf), of generally at least 2.0 mm, preferably at least 2.3 mm, and more preferably at least 2.5 mm, but not more than 4.0 mm, preferably not more than 3.5 mm, and more preferably not more than 3.2 mm. If the ball has a deflection hardness lower than the above range, the feel of the ball when hit may worsen and, particularly on shots taken with an iron, the spin rate may increase excessively, greatly shortening the carry. On the other hand, if the ball has a deflection hardness higher than the above range, the rebound of the ball tends to worsen and the carry on shots taken with a driver may decrease.

The golf ball according to a second aspect of the invention is a golf ball having a ball surface on which markings which may include lettering or a graphic image are printed with a marking ink that includes one or more rare-earth oxide composed of a single rare-earth element, or a rare-earth mixed oxide composed of a plurality of rare-earth elements mixed in a desired ratio.

The core and the cover of one or more layers in the foregoing golf ball are constituted in the same way as in the above-described first aspect of the invention.

Various known materials may be used as the vehicle and various colorants employed in the ink. The amount of rare-earth oxide or rare-earth mixed oxide included per 100 parts by weight of ink is from 1 to 50 parts by weight, and preferably from 3 to 40 parts by weight. Outside of this range, sufficient color rendering properties cannot be achieved and the durability of the ink is adversely affected.

A commonly used method may be employed to apply the markings onto the golf ball. Illustrative examples include direct printing methods which have a pad printing step; and indirect printing methods such as a transfer method in which a stamp presses a transfer film with a solid covering of ink against the ball, a method in which ink is cast onto surface features (stamped areas, etc.) on the surface of the ball proper, and thermal transfer printing. The type, position and number of marks placed on the ball are not subject to any particular limitation. For example, marks such as lettering, numbers, trade names and logos may be applied at any position on the ball. To further increase adhesion, the surface of the ball may be administered some kind of pre-treatment, such as blasting, primer treatment, plasma treatment or corona discharge treatment, prior to application of the markings.

The golf ball according to a third aspect of the invention is a one-piece golf ball which includes a rare-earth oxide or a rare-earth mixed oxide compounded in a core-forming rubber composition or in a coat-forming coating material. As in the first and second aspects of the invention, a known material can be used as the rubber composition making up the core. Details concerning the rare-earth oxide or rare-earth mixed oxide are the same as for the first and second aspects of the invention described above. The applied coat is not subject to any particular limitation, although the use of an ordinary urethane coating material is preferred. The amount of the rare-earth oxide or rare-earth mixed oxide included in the coating is preferably in a range of 0.1 to 50 parts by weight, and more preferably 0.5 to 30 parts by weight.

The golf balls according to the first, second and third aspects of the invention can be formed, in accordance with the Rules of Golf, to a diameter of not less than 42.67 mm and a weight of not more than 45.93 g.

As explained above, the inventive golf balls are balls which use an inorganic pigment having photochromism. These golf balls undergo a reversible change in color between exposure to a light source having a spectral distribution with a peak at the same wavelength as the absorption peak of the inorganic pigment in the visible light spectrum, and exposure to another light source, and moreover are highly visible and fashionable.

EXAMPLES

The following Examples of the invention and Comparative Examples are provided by way of illustration and not by way of limitation.

Examples 1 to 5, Comparative Examples 1 to 3

Solid cores were produced by using the rubber compositions shown in Table 1 and vulcanizing at 157° C. for 15 minutes.

Next, in each example, an inner cover layer material of the composition shown in Table 2 was mixed at 200 to 220° C. in a kneading-type twin-screw extruder, giving the inner cover layer material in pelletized form. This material was then injected into a mold in which the above-described solid core had been placed, thereby producing a solid core enclosed by the inner cover layer material.

In addition, an outer cover layer material of the composition shown in Table 2 was mixed at 200° C. in a kneading-type twin-screw extruder, giving the outer cover layer material in pelletized form. This material was then injected into a mold in which the above-described solid core enclosed in an inner cover layer material had been placed, thereby producing a three-piece solid golf ball.

The characteristics of each of the resulting golf balls are shown in Table 3. The appearance and properties of the respective balls were evaluated based on the following methods.

Ball Hardness and Solid Core Hardness

The compressive deformation (mm) of each of the resulting golf balls and solid cores when subjected to loading from an initial load of 10 kgf (98.07 N) to a final load of 130 kgf (1274.91 N) was measured.

Melt Index (MI) of Outer Cover Layer Material

This is the melt index (MI) of the material measured in accordance with JIS-K 7210 (test temperature, 190° C.; test load, 21 N (2.16 kgf)). The melt indices in Example 5 and Comparative Example 3 were obtained at a test temperature of 220° C.

Hardness of Inner Cover Layer and Outer Cover Layer

The cover materials were formed into 1 mm thick sheets. The hardness was the Shore D hardness measured according to ASTM D-2240.

Initial Velocity of Ball

Measured in accordance with the USGA (R&A) measurement method.

Ball Appearance (i) Color tone on exposure to sunlight:

Examined visually.

(ii) Color tone on exposure to three-wavelength fluorescent light:

Examined visually.

(iii) Presence/absence of change in color:

The balls were visually examined for the presence or absence of a change in color between exposure to three-wavelength fluorescent light and exposure to sunlight.

TABLE 1

| (parts by weight) | Example 1 | Example 2 | Example 3 | Example 4 | Example 5 | Comparative Example 1 | Comparative Example 2 | Comparative Example 3 |
|---|---|---|---|---|---|---|---|---|
| Polybutadiene | 100 | 100 | 100 | 100 | 100 | 100 | 100 | 100 |
| Zinc acrylate | 28.5 | 28.5 | 28.5 | 28.5 | 28.5 | 28.5 | 28.5 | 28.5 |
| Zinc oxide | 31.3 | 31.3 | 31.3 | 31.3 | 31.3 | 31.3 | 31.3 | 31.3 |
| Antioxidant | 0.1 | 0.1 | 0.1 | 0.1 | 0.1 | 0.1 | 0.1 | 0.1 |
| Zinc stearate | 5 | 5 | 5 | 5 | 5 | 5 | 5 | 5 |
| Zinc salt of pentachloro-thiophenol | 1 | 1 | 1 | 1 | 1 | 1 | 1 | 1 |
| Peroxide (1) | 0.6 | 0.6 | 0.6 | 0.6 | 0.6 | 0.6 | 0.6 | 0.6 |
| Peroxide (2) | 0.6 | 0.6 | 0.6 | 0.6 | 0.6 | 0.6 | 0.6 | 0.6 |

The core materials in Table 1 are described below.

Polybutadiene: BR01, produced by JSR Corporation.

Antioxidant: 2,2-Methylenebis(4-methyl-6-tert-butylphenol), produced by Ouchi Shinko Chemical Industry Co., Ltd. under the trade name Nocrac NS-6.

Peroxide (1): Dicumyl peroxide, produced by NOF Corporation under the trade name Percumil D.

Peroxide (2): 1,1-Bis(t-butylperoxy)-3,3,5-trimethylcyclohexane, produced by NOF Corporation under the trade name Perhexa 3M-40.

TABLE 2

| | (parts by weight) | Example 1 | Example 2 | Example 3 | Example 4 | Example 5 | Comparative Example 1 | Comparative Example 2 | Comparative Example 3 |
|---|---|---|---|---|---|---|---|---|---|
| Outermost layer of cover | Himilan 1557 | 50 | 50 | 50 | 50 | | 50 | 50 | |
| | Himilan 1601 | 50 | 50 | 50 | 50 | | 50 | 50 | |
| | Pandex T8295 | | | | | 50 | | | 50 |
| | Pandex T8260 | | | | | 50 | | | 50 |
| | Magnesium stearate | 1 | 1 | 1 | 1 | | 1 | 1 | |
| | Polyethylene wax | | | | | 1 | | | 1 |
| | Titanium oxide | | | | | 0.1 | | | 3 |
| | Pearlescent pigment | | | | 0.2 | | | 0.2 | |
| | Blue pigment | | | | | | | 0.3 | 0.3 |
| | Holmium oxide | 1 | 3 | 3 | 2 | 5 | | | |

TABLE 2-continued

| (parts by weight) | | Example 1 | Example 2 | Example 3 | Example 4 | Example 5 | Comparative Example 1 | Comparative Example 2 | Comparative Example 3 |
|---|---|---|---|---|---|---|---|---|---|
| Inner cover layer | Surlyn 7930 | 22.5 | 22.5 | 22.5 | 22.5 | 22.5 | 22.5 | 22.5 | 22.5 |
| | AM7311 | 22.5 | 22.5 | 22.5 | 22.5 | 22.5 | 22.5 | 22.5 | 22.5 |
| | Nucrel AN4318 | 25 | 25 | 25 | 25 | 25 | 25 | 25 | 25 |
| | Dynaron E6100P | 30 | 30 | 30 | 30 | 30 | 30 | 30 | 30 |
| | Yellow pigment | | | 0.3 | | | | | |
| | Blue pigment | | | | 0.2 | | | | |
| | Titanium oxide | 0.1 | 0.1 | | | 0.1 | 0.1 | 0.1 | 0.1 |
| | Magnesium stearate | 0.35 | 0.35 | 0.35 | 0.35 | 0.35 | 0.35 | 0.35 | 0.35 |

The above trade names and pigments are described below.

Himilan 1557, Himilan 1601, AM7311: Ionomer resins produced by DuPont-Mitsui Polychemicals Co., Ltd.

Pandex T8295, T8260: MDI-PTMG type thermoplastic polyurethanes produced by DIC Bayer Polymer, Ltd.

Surlyn 7930: An ionomer resin produced by E.I. du Pont de Nemours and Co.

Nucrel AN4318: An ethylene-methacrylic acid-acrylic acid ester terpolymer produced by DuPont-Mitsui Polychemicals Co., Ltd.

Dynaron E6100P: A block copolymer having crystalline olefin blocks, produced by JSR Corporation.

Polyethylene Wax: Produced by Sanyo Chemical Industries, Ltd. under the trade name Sanwax 161-P.

Pearlescent Pigment: A pearlescent pigment produced by Merck Japan, Ltd. under the trade name Iriodin 211.

Blue Pigment: Produced by Resino Color Industry Co., Ltd. under the trade name Resino Blue RT-K.

Yellow Pigment: Produced by Resino Color Industry Co., Ltd. under the trade name Resino Yellow 3GR #55.

Holmium Oxide: Holmium oxide powder produced by C.I. Kasei, Ltd. under the trade name NanoTek.

The invention claimed is:

1. A golf ball comprising a core, a cover of at least one layer that encloses the core, a coating, and a plurality of dimples on an outermost layer of the cover, the ball being characterized by containing in at least one constituent element thereof from 0.5 to 30 parts by weight of one or more rare-earth oxide composed of a single rare-earth element, or a rare-earth mixed oxide composed of a plurality of rare-earth elements mixed in a desired ratio, per 100 parts by weight of a base resin, wherein the rare-earth oxide or rare-earth mixed oxide is included in the coating, wherein the coating undergoes a reversible change in color between exposure to a light source having a spectral distribution with a peak at the same wavelength as the absorption peak of the rare-earth oxide or rare-earth mixed oxide in the visible light spectrum, and exposure to another light source, and wherein the rare-earth oxide is a compound selected from the group consisting of holmium oxide, praseodymium oxide, neodymium oxide, and erbium oxide.

2. A one-piece golf ball comprising a core having a coating, wherein a rare-earth oxide or a rare-earth mixed oxide is

TABLE 3

| | | Example 1 | Example 2 | Example 3 | Example 4 | Example 5 | Comparative Example 1 | Comparative Example 2 | Comparative Example 3 |
|---|---|---|---|---|---|---|---|---|---|
| Solid core | Diameter (mm) | 36.4 | 36.4 | 36.4 | 36.4 | 36.4 | 36.4 | 36.4 | 36.4 |
| | Hardness (mm) | 3.5 | 3.5 | 3.5 | 3.5 | 3.5 | 3.5 | 3.5 | 3.5 |
| Outermost layer of cover | Thickness (mm) | 1.5 | 1.5 | 1.5 | 1.5 | 1.5 | 1.5 | 1.5 | 1.5 |
| | Shore D hardness | 60 | 60 | 60 | 60 | 51 | 60 | 60 | 51 |
| | MI (g/10 min) | 2.1 | 2.1 | 2.1 | 2.1 | 28.7 | 2.1 | 2.1 | 28.7 |
| | Rebound resilience | 57 | 57 | 57 | 57 | 45 | 57 | 57 | 45 |
| Inner cover layer | Thickness (mm) | 1.65 | 1.65 | 1.65 | 1.65 | 1.65 | 1.65 | 1.65 | 1.65 |
| | Shore D hardness | 51 | 51 | 51 | 51 | 51 | 51 | 51 | 51 |
| Ball | Weight (g) | 45.4 | 45.4 | 45.4 | 45.4 | 46.1 | 45.4 | 45.4 | 46.1 |
| | Diameter (mm) | 42.7 | 42.7 | 42.7 | 42.7 | 42.7 | 42.7 | 42.7 | 42.7 |
| | Hardness (mm) | 2.7 | 2.7 | 2.7 | 2.7 | 2.9 | 2.7 | 2.7 | 2.9 |
| | Initial velocity (m/s) | 77.1 | 77.1 | 77.1 | 77.1 | 76.4 | 77.1 | 77.1 | 76.4 |
| Ball appearance | Color tone under sunlight | white | white | light yellow | light pearlescent blue | white | white | pearlescent blue | bluish white |
| | Color tone under three-wavelength fluorescent light | light pink | light pink | light orange | light pearlescent blue-violet | light pink | white | pearlescent blue | bluish white |
| | Color change Yes/No | yes | yes | yes | yes | yes | no | no | no |

compounded in a core-forming rubber composition or in a coat-forming coating material, wherein the core-forming rubber composition or the coating material undergoes a reversible change in color between exposure to a light source having a spectral distribution with a peak at the same wavelength as the absorption peak of the rare-earth oxide or rare-earth mixed oxide in the visible light spectrum, and exposure to another light source, and wherein the rare-earth oxide is a compound selected from the group consisting of holmium oxide, praseodymium oxide, neodymium oxide, and erbium oxide.

* * * * *